United States Patent [19]

Hwang

[11] Patent Number: 4,458,383

[45] Date of Patent: Jul. 10, 1984

[54] SAFETY GUARD DEVICE FOR WALLET

[76] Inventor: Jau-Tsong Hwang, No. 85-3, Yu-Ming St., Chung Chuan Li, Chang Hua City, Taiwan

[21] Appl. No.: 372,828

[22] Filed: Apr. 28, 1982

[51] Int. Cl.[3] ..... A44B 17/00

[52] U.S. Cl. ..... 24/3 L; 24/647; 24/664; 224/252

[58] Field of Search ..... 24/3 H, 3 J, 3 K, 3 L, 24/4, 211 R, 211 M, 217 R, 216, 219, 220, 208 R, 208 A; 224/195, 224, 226, 230, 253, 271, 252, 268, 269

[56] References Cited

U.S. PATENT DOCUMENTS

| | | | |
|---|---|---|---|
| 493,559 | 3/1893 | Pfenning | 24/211 M |
| 529,147 | 11/1894 | Oostrum | 24/211 M |
| 573,059 | 12/1896 | Oostrum | 24/211 M |
| 615,474 | 12/1898 | Brauch | 24/211 M |
| 1,271,650 | 7/1918 | Arkin | 24/211 L |
| 1,362,916 | 12/1920 | Barber | 24/3 H |
| 2,629,156 | 2/1953 | Kamens et al. | 24/211 M |
| 3,743,147 | 7/1973 | Wilczynski | 224/271 |
| 3,822,446 | 7/1974 | Silverstein | 24/3 H |
| 4,121,323 | 10/1978 | Letostak | 24/3 H |
| 4,358,036 | 11/1982 | Maltais | 224/252 |

*Primary Examiner*—Robert Peshock
*Assistant Examiner*—Kris R. Schulze
*Attorney, Agent, or Firm*—Cushman, Darby & Cushman

[57] ABSTRACT

A safety guard device for a wallet includes a salient button which penetrates the corner or the edge of the laminae of a wallet and fastens with a lock base that is installed in the upper portion of one's trouser pocket or at the lower end of a belt clamp. To remove the wallet, one presses down on the tenon button which is hidden inside the trousers or inside the lower end of the belt clamp. In addition to being convenient in use, the present invention can effectively prevent one's wallet from being picked, snatched or lost.

2 Claims, 5 Drawing Figures

SAFETY GUARD DEVICE FOR WALLET

SUMMARY OF THE INVENTION

The present invention relates to a safety guard device for wallets which includes relatively simple mechanical structures to be used as the safety means. The primary advantage of the present invention is that a wallet can be easily locked for security yet can also be easily removed by the user when desired. Once the wallet is locked by the present invention, it is then very difficult to be picked by a pickpocket or snatched by a snatcher. In other words, the present invention is simple to use, and can prevent theft or loss of one's wallet.

BACKGROUND OF THE INVENTION

Today, the wallet has become a popular accessory to permit people to carry important papers and certificates, valuables, and the like. Thus, if one's wallet should ever become lost or stolen, it would cause the user to suffer serious economic loss not to mention inconveniences. Unfortunately, since modern morals have been deteriorating and pickpocketing has increased, the person who carries a wallet is liable to be a target for the unlawful activities of the pickpocket or snatcher. In view of the above facts, the inventor has, through careful and long studies, developed the present invention so as to prevent one's wallet from being lost without causing inconvenience during normal use.

BRIEF DESCRIPTION OF THE ACCOMPANYING DRAWINGS

DETAILED DESCRIPTION OF THE PREFERRED EXEMPLARY EMBODIMENTS

Figure 1:
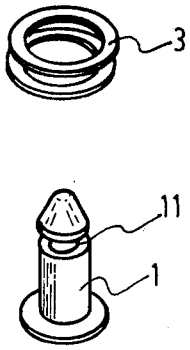
FIG. 1 shows a perspective view of the salient button and the collar according to the present invention.

The present invention mainly comprises the salient button (1), and the lock base (2), and their structures and functions are described in detail by referring to the accompanying drawings and the photos as follows:

As shown in FIG. 1, the outer shape of the salient button (1) resembles a vertical post, of which the rounded head is provided with a ring-shaped channel (11). The base is formed into a disk so as to facilitate connection of the salient button (1) and the corner or the edge of the inner laminae of the wallet. Further, when the wallet is folded, the top end of the salient button (1) will penetrate through the collars (3) on each lamina of the wallet, and will extend out of the wallet so as to be buckled to the lock base (2) to securely lock and close the entire wallet in its folded condition.

Figure 2:
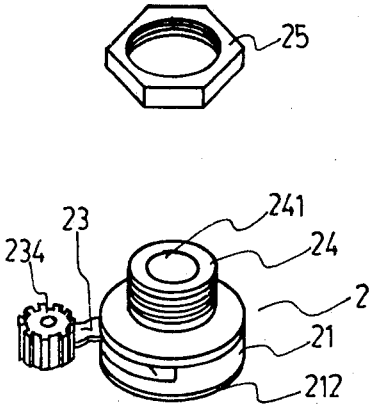
FIG. 2 shows a perspective view of the lock base according to the present invention.
Figure 3:
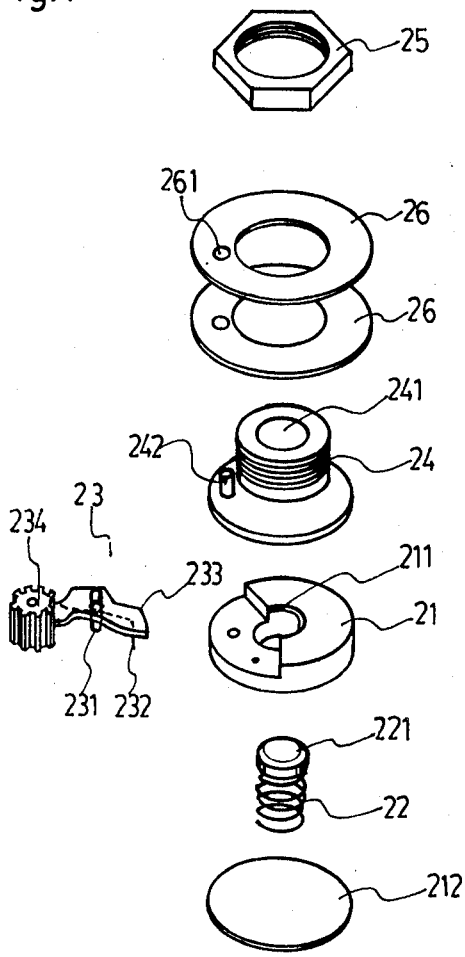
FIG. 3 shows an exploded perspective of the lock base.

As shown in FIGS. 2 and 3, the lock base (2) comprises body (21), a spring (22), the catch tenon (23) for locking the salient button (1), a threaded cylinder (24) and a nut (25). Body (21) resembles a flat ring and is provided with an inner rail (211), and a sector notch for installing the catch tenon (23). At the bottom of catch tenon (23), a positioning pin (231) and a torque spring (232) are provided. By using the positioning pin (231) as a fulcrum and the force of the torque spring (232), the tenon end (233) of catch tenon (23) normally extends into the hole of body (21). Tenon end (233) can be retracted when the tenon button (234) is pivoted about positioning pin (231). On the top of spring (22), a spring lid (221) is fixedly attached. Spring (22) is, by virtue of the bottom hole of body (21), placed into the space between the inner rail (211) and the base plate (212). The threaded cylinder (24) is fixedly attached to the upper portion of the body (21). In the center of the threaded cylinder (24), a cylinder hole (241) is provided so as to allow the salient button (1) to pass therethrough. At the base of the threaded cylinder, a positioning pin (242) is provided. From the top of threaded cylinder (24), the washer (26) is fitted therein and is fixed thereto by nut (25).

When using the lock base (2), one or two washers are installed by rivets or other conventional fixing methods on selected positions at the upper portion of one's pocket. Then, the threaded cylinder (24) of the lock base (2) is passed through the washer (26) from inside of one's trousers to the outside. The positioning pin (242) of the threaded cylinder (24) penetrates through the positioning hole (261) of the washer (26) so as to prevent the entire lock base (2) from rotating when the tenon button (234) of the catch tenon (231) is manipulated. The portion of threaded cylinder (24) which extends beyond washer (26) accepts nut (25) so as to securely fix the lock base (2) at a suitable location on the upper portion of one's trouser pocket.

Figure 5:
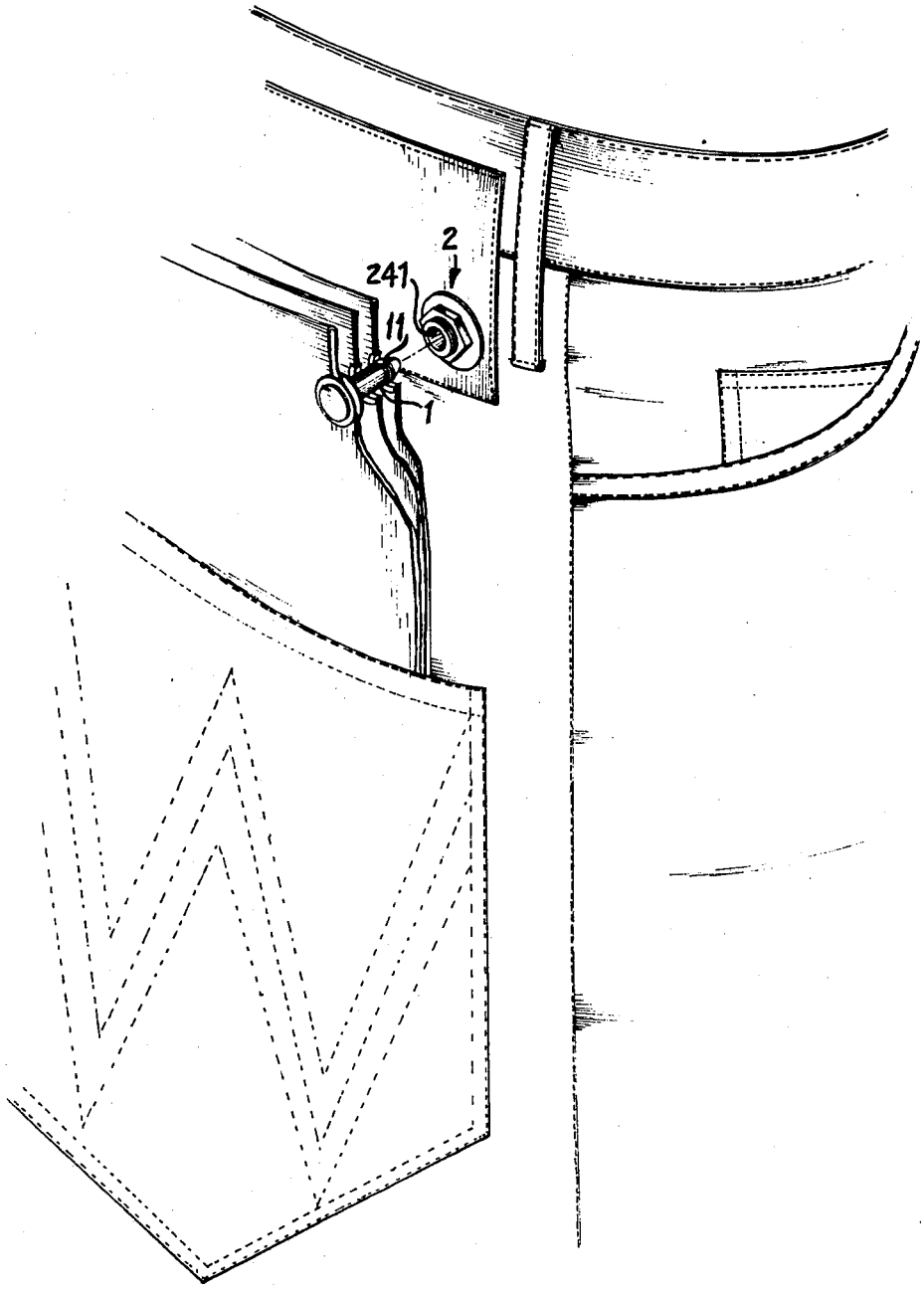
FIG. 5 shows a perspective view of the present invention in use.

FIG. 5 shows one embodiment of this invention. When using the present invention, one merely pushes the top end of salient button (1) which extends outside the wallet into the cylinder hole (241) of the lock base (2). This action allows the catch tenon (23) (not shown in FIG. 5) to be automatically engaged with the ring-shaped channel (11) of salient button (1) so as to lock the wallet in position. When one desires to remove the wallet, the tenon button (234) (see FIGS. 2 and 3) is pushed so as to pivot catch tenon (23) out of engagement with channel (11) and the salient button (1) will then be free to be automatically ejected from lock base (2) by virtue of the biasing force of the spring (22) inside the body (21). Thus, the present invention is rather convenient in operation.

Figure 4:
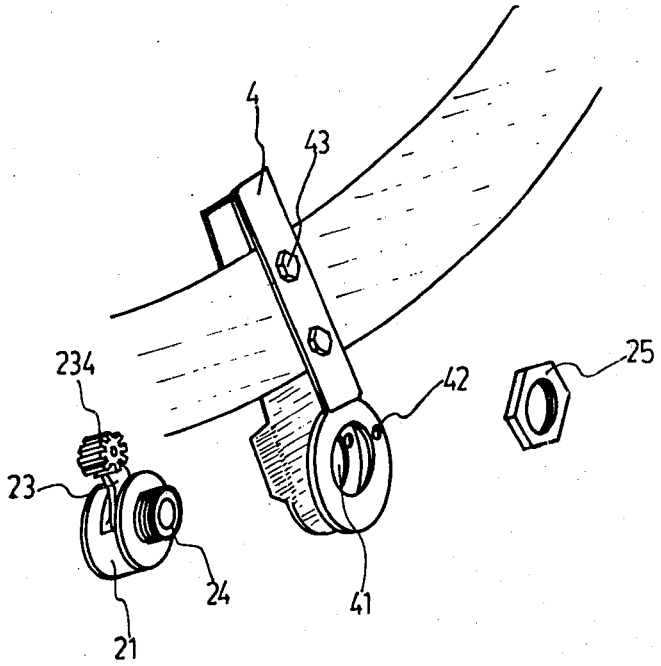
FIG. 4 shows an embodiment of the lock base being attached to a belt by means of a belt clamp.

FIG. 4 shows another embodiment of the present invention, in which lock base (2) is attached to a belt clamp (4). In this embodiment, the threaded cylinder (24) of the lock base (2) penetrates, from inside to outside, through round hole (41) at the lower end of belt clamp (4), and is then locked in position with the nut (25). Similarly, the positioning pin (242) of threaded cylinder (24) is inserted into the positioning hole (42) of the belt clamp (4) for the purpose of ensuring that tenon button (234) will be upwardly disposed so as to be readily accessable to the user. The two screws (43) furnished on the belt clamp (4) are used for adjusting belt clamp (4) to a suitable position (e.g. the fastening position of the lock base (2) and the salient button (1) so as to firmly lock it to one's belt.

In summary, it may be concluded that the salient button (1) will penetrate a number of liminae of the wallet, and fasten to lock base (2) that is either installed in the upper portion of one's trousers near the rear pocket or at the lower end of the belt clamp (4) so as to fasten the wallet in position for safety purposes. Since the tenon button (234) is hidden inside the trousers or inside the lower end of the belt clamp (4), it is difficult to be picked by a pickpocket. To the user, it is rather easy to securely lock the wallet or remove it. Thus, all the user must do is to lightly push the salient button (1) into the lock base (2), or to push the tenon button (234). This invention can effectively prevent one's wallet from being picked, stolen, snatched, or lost, and is considered to be a novel design.

I claim:

1. A safety guard device for securing a wallet to an article of clothing comprising:

an elongated locking post adapted to being fixed to the wallet and including means defining a locking channel;

a locking member adapted to being fixed to the article of clothing and including body means defining a central aperture for receiving said locking post, lever means pivotably connected to said body means and having opposing ends, one of said ends moveable into and out of locking engagement with said locking channel when said locking post is received in said aperture in response to said lever means being pivoted between locked unlocked positions, respectively, means biasing said lever means into said locked position, and ejecting means operatively associated with said aperture for ejecting said locking post from said aperture when said lever means is pivoted to said unlocked position; and attaching means for fixedly attaching said locking member to the article of clothing and for positioning the other of said ends to permit access thereto and to permit said other end to be manipulated so as to pivot said lever means between said locked and unlocked positions, wherein said body means further includes an upstanding attachment member and an upstanding positioning pin and wherein said attaching means includes at least one washer means defining a central opening accommodating said attachment member to secure a portion of the article of clothing between said body means and said washer means, said washer means further defining a position pin aperture registrable with said positioning pin, and retaining means retaining said washer means, wherein said position pin aperture determines the relative position of said other end of said lever means by virtue of said positioning pin being registered therewith.

2. A safety guard device for securing a wallet to a belt comprising:

an elongated locking post adapted to being fixed to the wallet and including means defining a locking channel;

a locking member including body means defining a central aperture for receiving said locking post, lever means pivotably connected to said body means and having opposing first and second ends, said first end moveable into and out of locking engagement with said locking channel when said lever means is pivoted between locked and unlocked positions, respectively, said second end adapted to be manipulated so as to pivot said lever between said positions means biasing said lever means into said locked position, and ejecting means operatively associated with said aperture for ejecting said locking post from said aperture when said lever means is pivoted to said unlocked position; and belt clamp means for appendantly attaching said locking member to the belt including a generally U-shaped member having means defining registered openings at each opposing end of said U-shaped member for receiving an upstanding attachment member on said locking member therethrough, said U-shaped member further including positioning pin apertures adjacent said registered openings and said body means includes an upstanding positioning pin registrable with said positioning pin apertures wherein said positioning pin apertures determines the relative position of the second end of said lever by virture of said positioning pin being registered with the positioning pin apertures, and means for coupling said locking member to said each opposing end of the U-shaped member, said belt clamp means further including clamp positioning means for positioning said belt clamp means along the belt and for fixing said belt clamp means to the belt.

* * * * *